US008747515B2

(12) United States Patent
Duz et al.

(10) Patent No.: US 8,747,515 B2
(45) Date of Patent: Jun. 10, 2014

(54) FULLY-DENSE DISCONTINUOUSLY-REINFORCED TITANIUM MATRIX COMPOSITES AND METHOD FOR MANUFACTURING THE SAME

(75) Inventors: Volodymyr Duz, Hudson, OH (US); Vladimir S. Moxson, Hudson, OH (US); Alexander E. Shapiro, Upper Arlington, OH (US)

(73) Assignee: Advance Material Products, Inc, Twinsburg, OH (US)

( * ) Notice: Subject to any disclaimer, the term of this patent is extended or adjusted under 35 U.S.C. 154(b) by 281 days.

(21) Appl. No.: 10/748,619

(22) Filed: Dec. 27, 2003

(65) Prior Publication Data

US 2007/0269331 A1 Nov. 22, 2007

(51) Int. Cl.
*C22C 29/02* (2006.01)

(52) U.S. Cl.
USPC ..... 75/236; 419/15

(58) Field of Classification Search
USPC ..... 419/45, 15; 428/614; 75/236
See application file for complete search history.

(56) References Cited

U.S. PATENT DOCUMENTS

| | | | | | |
|---|---|---|---|---|---|
| 4,410,412 | A | * | 10/1983 | Kugler | 204/288.1 |
| 4,731,115 | A | | 3/1988 | Abkowitz et al. | |
| 4,906,930 | A | | 3/1990 | Nakane et al. | |
| 4,917,858 | A | | 4/1990 | Eylon et al. | |
| 4,961,529 | A | * | 10/1990 | Gottselig et al. | 228/124.1 |
| 4,968,348 | A | | 11/1990 | Abkowitz et al. | |
| 4,987,033 | A | | 1/1991 | Abkowitz et al. | |
| 5,059,490 | A | * | 10/1991 | Brupbacher et al. | 428/614 |
| 5,336,291 | A | | 8/1994 | Nukami et al. | |
| 5,366,570 | A | | 11/1994 | Mazur et al. | |
| 5,534,353 | A | | 7/1996 | Kaba et al. | |
| 5,624,505 | A | | 4/1997 | Mazur et al. | |
| 5,696,619 | A | * | 12/1997 | Knipe et al. | 359/224.1 |
| 5,722,037 | A | * | 2/1998 | Chung et al. | 419/45 |
| 5,897,830 | A | | 4/1999 | Abkowitz et al. | |
| 7,189,342 | B2 | * | 3/2007 | Ferguson | 252/512 |
| 2003/0084969 | A1 | * | 5/2003 | Toyoda et al. | 148/421 |

OTHER PUBLICATIONS

Moll et al, "*Production of Titanium Powder*," ASM Handbook, vol. 7, Powder Metal Technologies and Applications, pp. 160-166, ASM International, Materials Park, Ohio, 1998.

Froes et al., "*Powder Metallurgy of Titanium Alloys*," International Material Reviews, 1990, vol. 35, No. 3, pp. 162-182.

* cited by examiner

*Primary Examiner* — Weiping Zhu
(74) *Attorney, Agent, or Firm* — Dickinson Wright PLLC

(57) ABSTRACT

The invention is suitable for the manufacture of flat or shaped titanium matrix composite articles having improved mechanical properties such as lightweight plates and sheets for aircraft and automotive applications, heat-sinking lightweight electronic substrates, bulletproof structures for vests, partition walls and doors, as well as for sporting goods such as helmets, golf clubs, sole plates, crown plates, etc. A fully-dense discontinuously-reinforced titanium matrix composite (TMMC) material comprises (a) a matrix of titanium or titanium alloy as a major component, (b) ceramic and/or intermetallic hard particles dispersed in the matrix in the amount of ≤50 vol. %, and (c) complex carbide- and/or silicide particles at least partially soluble in the matrix at the sintering or forging temperatures such as $Ti_4Cr_3C_6$, $Ti_3SiC_2$, $Cr_3C_2$, $Ti_3AlC_2$, $Ti_2AlC$, $Al_4C_3$, $Al_4SiC_4$, $Al_4Si_2C_5$, $Al_8SiC_7$, $V_2C$, (Ti,V)C, $VCr_2C_2$, and $V_2Cr_4C_3$ dispersed in the matrix in the amount of ≤20 vol. %. The invention can be used to produce near-full density near-net shape parts from titanium matrix composite materials with acceptable mechanical properties without a hot deformation.

6 Claims, No Drawings

FULLY-DENSE DISCONTINUOUSLY-REINFORCED TITANIUM MATRIX COMPOSITES AND METHOD FOR MANUFACTURING THE SAME

FIELD OF THE INVENTION

The present invention relates to sintered titanium metal matrix composites discontinuously-reinforced with dispersed particles ceramics and intermetallics such as titanium carbides, tungsten carbides, titanium aluminides, etc.

BACKGROUND OF THE INVENTION

Titanium-based or titanium alloy-based metal matrix composites (TMMC) are of particularly great interest in the following areas: the aerospace and automotive industries, medical implants and chemical-resistant applications due to their high specific strength, their high stiffness, low weight, and relatively high wear resistance. The titanium or titanium alloy matrix in these composites are reinforced by fibers or particles which have a substantially higher hardness and elastic modulus than the matrix alloy. Reinforcing components should be thoroughly and uniformly dispersed in the volume of the matrix alloy to achieve the maximum mechanical properties of the composite material. In addition, the strength of the composite material depends on the size of the reinforcing particles, strength of the bond between the hard particles and the matrix, and the porosity of sintered composite materials.

Despite more than twenty years of experience in industrial applications, conventional TMMC are far from perfection and used on a limited scale in industrial applications. They do not completely realize the strength benefits of the reinforced structure due to not optimal composition and technology, and especially, due to remaining interconnecting porosity of resulting composite materials.

For example, the method for manufacturing the Ti-6Al-4V/TiC composite disclosed in the U.S. Pat. No. 5,722,037 provides the density of the resulting material only about 93% of the theoretical value even after vacuum sintering for 4 hours at 1300° C. The method includes formation of reinforcing TiC particles in the titanium matrix by chemical reaction with hydrocarbon gas that is more effective in the porous matrix than in the dense one.

In the U.S. Pat. No. 4,731,115 granted to Abkowitz, et al., a TiC/titanium alloy composite cladding material and process for manufacturing the same are disclosed, in which blended components are compacted by cold isostatic pressing and sintered at 2200-2250° F. However, this method does not provide sufficient density of the material, and to improve the density, the invention further includes encasing the sintered pre-form and hot isostatic pressing (HIP) at 1650-2600° F. followed by finish forging, rolling, or extruding. This method is not cost-effective due to additional HIP step and encasing (canning) that should be removed from the final product by grinding or chemical milling. Moreover, the HIP process does not permit production of articles with close tolerances of their sizes. The presence of encasing testifies that the sintered composite material has interconnected porosity that results in the necessity to protect against oxidation during the hot deformation steps.

T. Kaba, et al. (U.S. Pat. No. 5,534,353) proposed compacting a powdered component blend by cold isostatic pressing, atomizing the product by melting and spraying, and finally, sintering the atomized powder by HIP at 1100° C. (2012° F.). The final product has improved bending strength at room temperature, but includes atomizing in a protective atmosphere, and it still has an interconnected porosity which requires additional encapsulating step for the HIP with a consequent increase in production costs.

All previous technologies of fabricating dense titanium matrix composites from matrix and reinforcing powders have considerable drawbacks that make them undesirable in terms of density, strength, and ductility of resulting products, sufficient protection from oxidation, cost, and production capacity. The interconnected porosity causes very rapid oxidation of the reactive titanium powder to a substantial depth, and capsules or cases (that are required for subsequent consolidation to near full density in known inventions) do not fully protect the sintered article from rapid oxidation, and also increase production costs. A significant difference in structural and mechanical properties between sintered material and the capsule produced from non-reactive wrought metal results in non-uniform deformation and stress concentration in the TMMC during the hot deformation. Cracks occur in various areas of the sintered material during the first cycles of hot deformation because of interconnected porosity and stress concentration. These cracks do not allow maintaining a reliable and reproducible manufacturing process through forging or hot rolling.

Therefore, it would be desirable to provide (a) a high-strength and fully-dense titanium matrix composites having discontinuous porosity after sintering, and (b) a cost-effective method for producing such composites using blended elemental powders or combination of pre-alloyed and elemental metal powder blends, as well. A new composition and method should improve the mechanical performance of resulting materials and further eliminate destructive porosity and oxidation during subsequent high-temperature processing that is required in order to achieve a near full density with acceptable mechanical properties.

This present invention achieves this goal by using complex carbides as additional reinforcing components in the Ti/TiC composite structure, and by providing a method through which the sintered structure has only the discontinuous porosity at the near full density, while at the same time, the composite material exhibits acceptable mechanical properties in the as-sintered conditions, and/or it is manufactured during foregoing hot deformation without any encasing, canning, or encapsulating if more complicated shapes with improved size control of the finished parts or improved properties are required.

OBJECTS OF THE INVENTION

It is therefore an object of the invention to produce a fully-dense, essentially uniform structure of flat and shaped titanium metal matrix composite consisting of high-strength and ductile matrix that is gradually-reinforced with carbide particles, which provides improved mechanical characteristics such as toughness, flexure strength, impact strength, and wear resistance.

Another object of this invention is to avoid interconnected porosity and provide the sintered structure with only discontinuous porosity at maximal possible density after sintering, e.g., over 98% of the theoretical value.

Yet, another object of this invention is to produce near-full density parts from a titanium matrix composite material that has acceptable mechanical properties without a need for further hot deformation.

It is yet another object of this present invention is to provide a powder metallurgy technique for manufacturing near-net shape sintered TMMC that can be used as final product in the as-sintered state or in the state after hot deformation without finishing by machining or chemical milling.

It is yet another additional object of the invention to establish a continuous cost-effective process to produce fully-dense flat and shaped titanium alloy matrix composite parts with controlled size tolerances from either blended elemental powders and from a combination of the pre-alloyed and elemental powders blend.

The nature, utility, and features of this invention will be more apparent from the following detailed description with respect to preferred embodiments of the invented technology.

SUMMARY OF THE INVENTION

While the use of a number of technologies for sintering and hot deformation has previously been contemplated in the titanium matrix composite industry as mentioned above, problems related to the formation of dense pre-form able to suit a composite structure even during low-temperature consolidation, process stability, controlled sizes with close tolerances, and production costs, defective microstructure, residual porosity, and insufficient mechanical properties of dense TMMC articles, have not been solved. This invention overcomes shortcomings in the prior art.

The goals of the invention are (a) to change the type of porosity of the sintered semi-product from the interconnecting porosity to only discontinuous porosity at maximal possible density, e.g., over 98% of the theoretical value after sintering, and (b) to reduce a cost of production process for manufacturing fully-dense titanium matrix composite with improved mechanical properties.

We focused on the manufacturing engineering aspects of TMMC and TMMC-reinforcing component fabrication with the goal of stabilizing the production of these materials. To this end, we have developed an affordable process utilizing both reactive powder alloys and a cost-effective manufacturing approach that has made a possible transition to production.

An attempt was made to produce discontinuously reinforced TMMC using a blended elemental powder metallurgy approach. A newly developed process allows uniform distribution of reinforcing particles in the ductile matrix while improving the bond strength between the reinforcing particulate and the matrix alloy.

A fully-dense discontinuously-reinforced titanium matrix composite (TMMC) material comprises (a) a matrix of titanium or titanium alloy as a major component, (b) ceramic and/or intermetallic hard particles dispersed in the matrix in the amount of ≤50 vol. %, and (c) complex carbide- and/or silicide particles at least partially soluble in the matrix at the sintering or forging temperatures such as $Ti_4Cr_3C_6$, $Ti_3SiC_2$, $Cr_3C_2$, $Ti_3AlC_2$, $Ti_2AlC$, $Al_4C_3$, $Al_4SiC_4$, $Al_4Si_2C_5$, $Al_8SiC_7$, $V_2C$, (Ti,V)C, $VCr_2C_2$, and $V_2Cr_4C_3$, dispersed in the matrix in the amount of ≤20 vol. %. The method for manufacturing TMCC is comprised of the following steps: (a) preparing a basic powdered blend containing matrix alloy or titanium powders, dispersing ceramic and/or intermetallic powders, and powders of said complex carbide- and/or silicide particles, (b) preparing the Al—V master alloy containing ≤5 wt. % of iron, (c) preparing the Al—V—Fe master alloy fine powder having a particle size of ≤20 μm, (d) mixing the basic powdered blend with the master alloy powder to obtain a chemical composition of TMCC, (e) compacting the powder mixture at room temperature, (f) sintering at the temperature which provides at least partial dissolution of dispersed powders, (g) forging at 1500-2300° F., and (h) cooling. The ceramic and/or intermetallic hard particles dispersed in the matrix are selected from the group consisting of TiC, $B_4C$, SiC, ZrC, TaC, WC, NbC, TiAl, $Ti_3Al$, $TiAl_3$, $TiAlV_2$, $Al_8V_5$, and $TiCr_2$.

A combination of unique properties of (i) high strength and stiffness at temperatures up to 1500° F., (ii) good mechanical properties at room temperature including good ductility, (iii) improved resistance to matrix cracking, and (iiii) very close controlled tolerances of sizes of the finished parts which is achieved in the resulting material by forming a discontinuous porosity of sintered semi-product followed by effective densification during hot deformation steps.

The invented composition and method are suitable for the manufacture of flat or shaped titanium matrix composite articles having improved mechanical properties such as lightweight plates and sheets for aircraft and automotive applications, heat-sinking lightweight electronic substrates, bullet-proof structures for vests, partition walls and doors, as well as sporting goods such as helmets, golf clubs, sole plates, crown plates, etc.

The subsequent objects, features, and advantages of our invented material and process will be clarified by the following detailed description of the preferred embodiments of the invention.

DETAILED DESCRIPTION AND PREFERRED EMBODIMENTS OF THE INVENTION

As discussed, the present invention relates generally to the manufacture of titanium matrix composites that are reinforced by ceramic and/or intermetallic particles using the combination of elemental and pre-alloyed powders (obtained by atomization or other method), elemental metal powder blends, and/or titanium hydrides, or a combinations thereof (i.e. combination of pre-alloyed, elemental and/or hydrides powders as raw materials).

The use of preliminary prepared fine powder of Al—V—Fe master alloy plays an unique role in this process which result in the formation of a highly-dense structure during the sintering in order to obtain a semi-finished product or finished product having solely closed discontinuous porosity at density over 98% of the theoretical value. No previously known methods, mentioned in References, allow producing such composite structure after sintering by using traditional approaches.

The addition of complex carbide- and/or silicide particles that are at least partially soluble in the matrix such as $Cr_3C_2$, $Ti_4Cr_3C_6$, $Ti_3SiC_2$, $Ti_3AlC_2$, $Ti_2AlC$, $Al_4C_3$, $Al_4SiC_4$, $Al_4Si_2C_5$, $Al_8SiC_7$, $V_2C$, (Ti,V)C, $VCr_2C_2$, and $V_2Cr_4C_3$ dispersed in the matrix in the amount of ≤20 vol. % allows not only control ductility of the matrix during any hot deformation of the sintered pre-form, but also significantly improves the effect of particle reinforcement of the resulting composite material.

Complex carbides combine merits of both metals and ceramics. Like metals, they are resistant to thermal shock, but like ceramics, they have high strength, hardness, and thermal stability. Such complex carbides as $Ti_3AlC_2$, $Ti_4Cr_3C_6$, $Ti_3SiC_2$, and $Ti_2AlC$ have unique compressive plasticity at room and high temperature that allows plastic deformation of the reinforced matrix without cracking. When the sintered composite material pre-form is heated to 1500-1700° F. for forging or hot rolling, the complex carbides are partially dissolved in the matrix, and the matrix alloy being freed of the carbide reinforcements is easily deformed at these temperatures. Complex carbide phases are precipitated during cooling after hot deformation and fix fine grain structure of forged or hot rolled composite material.

The invented composition and method provide manufacturing fully-dense flat and shaped titanium matrix composites with improved mechanical properties while using the cost-effective production approach.

The foregoing examples of the invention are illustrative and explanatory. The examples are not intended to be exhaustive and serve only to show the possibilities of the invented technology.

EXAMPLE 1

A carbide-reinforced titanium composite material based on the Ti-6Al-4V alloy matrix was manufactured by (a) preparing a basic powder blend containing titanium powder and having a particle size over 20 μm for 95% of the powder, 5% of graphite, 2.5% of dispersing TiC powder, and 2.5% of dispersing powders of $Ti_3AlC_2$ and $Ti_2AlC$ complex carbide particles partially soluble in the matrix at 1500-2300° F., (b) preparing a Al—V—Fe master alloy containing 2% of iron, (c) making a powder of Al—V—Fe master alloy having a particle size of 10 μm and less, (d) mixing the basic powder blend with the master alloy powder, in the ratio of 9:1 to obtain a chemical composition of titanium matrix composite material, (e) compacting the powder mixture at room temperature by cold isostatic pressing, (f) sintering at 2300° F., (g) forging at 1600° F., and (h) cooling.

Sintered semi-product had density 98.7% with closed discontinuous porosity that allowed to carry out forging in air without encapsulating (or encasing). The resulting TiC/Ti-6Al-4V composite material has 100% density, and exhibits improved yield strength at room temperature and at 930° F. (500° C.).

EXAMPLE 2

A carbide-reinforced titanium composite material based on the Ti-6Al-4V alloy matrix was manufactured by (a) preparing a basic powder blend containing titanium powder having a particle size over 20 μm for 95% of the powder, 2% of graphite, 5% of dispersing TiC powder, and 2.5% of dispersing $Cr_3C_2$ particles partially soluble in the matrix at 1500-2300° F., (b) preparing a Al—V—Fe master alloy containing 2% of iron, (c) making a powder of Al—V—Fe master alloy having a particle size of 10 μm and less, (d) mixing the basic powder blend with the master alloy powder, in the ratio of 9:1 to obtain a chemical composition of titanium matrix composite material, (e) compacting the powder mixture at room temperature by die-pressing, (f) sintering at 2350° F., (g) forging at 1600° F., and (h) cooling.

Sintered semi-product had a density of 99% with closed discontinuous porosity that allowed it to carry out forging in open air without encapsulating (or encasing). The resulting carbide-reinforced Ti-6Al-4V matrix composite material has 100% density, and it exhibits improved yield strength at room temperature and at 930° F. (500° C.), and satisfied oxidation resistance up to 1470° F. (800° C.).

EXAMPLE 3

The titanium matrix composite was manufactured using the same raw materials for Ti-6Al-4V matrix alloy and carbide reinforcements, and the same mode of sintering as in Example 1. The final hot deformation was made by hot rolling at 1650° F. instead of forging.

The resulting TiC/Ti-6Al-4V composite material also had 100% density, and exhibited satisfied yield strength at room temperature and at 930° F. (500° C.).

EXAMPLE 4

The carbide-reinforced titanium composite material based on the Ti-6Al-4V alloy matrix was manufactured by (a) preparing a basic powder blend containing titanium powder having a particle size over 20 μm for 95% of the powder, 5% of graphite, 2.5% of the dispersing TiC powder, and 2.5% of the dispersing $Cr_3C_2$ and $Ti_4Cr_3C_6$ complex carbide particles partially soluble in the matrix at 1500-2300° F., (b) preparing a Al—V—Fe master alloy containing 2% of iron, (c) making a powder of Al—V—Fe master alloy having a particle size of 10 μm and less, (d) mixing the basic powder blend with the master alloy powder at the ratio of 9:1 to obtain a chemical composition of titanium matrix composite material, (e) compacting the powder mixture at room temperature by cold isostatic pressing, (f) sintering at 2450° F., and (g) cooling.

The resulting composite material has density 99.2% of the theoretical value with closed discontinuous porosity and exhibits acceptable yield strength at room temperature and at 930° F. (500° C.). The cost-effective plate of this material was used as final product without hot deformation.

We claim:

1. A fully-dense, discontinuously-reinforced, sintered titanium matrix composite material having improved mechanical characteristics including toughness, flexure strength, impact strength, and wear resistance, and having an essentially uniform structure suitable for forming flat or shaped composite articles, comprising (a) a matrix of titanium or titanium alloy as a major component, (b) ceramic and/or intermetallic hard particles dispersed in the matrix in the amount greater than zero, and less than 50% by volume, which include particles of the compound $Al_8V_5$, and (c) particles that are complex carbides, that are at least partially soluble in the matrix at the sintering or forging temperatures, or complex silicides that are at least partially soluble in the matrix at the sintering or forging temperatures, or both, wherein the ceramic and/or intermetallic hard particles dispersed in the matrix are incorporated into the titanium matrix composite during the preparation and before sintering of a basic powdered blend to produce near-full density parts from a titanium matrix composite material that has acceptable mechanical properties without a need for further hot deformation.

2. The fully-dense discontinuously-reinforced titanium matrix composite material according to claim 1 is characterized by discontinuous porosity at the density over 98% from the theoretical value.

3. The fully-dense discontinuously-reinforced titanium matrix composite material according to claim 1, wherein the matrix alloy is selected from a-titanium alloys, (a+β)-titanium alloys, β-titanium alloys, and titanium aluminide alloys.

4. The fully-dense discontinuously-reinforced titanium matrix composite material according to claim 1, wherein graphite hard particles and hard particles of silicon carbide SiC are added in amount of 40% or less of the total amount of said hard particles dispersed in the titanium matrix.

5. The fully-dense discontinuously-reinforced titanium matrix composite material according to claim 1, wherein said complex carbide-silicide and carbide-aluminide hard particles are dispersed in the matrix in the amount of about 20% by volume and at least partially soluble in the matrix at sintering and forging temperatures.

6. The fully-dense discontinuously-reinforced titanium matrix composite material according to claim 1 wherein the complex carbide particles are selected from the group $Ti_4Cr_3C_8$, $Ti_3SiC_2$, $Cr_3C_2$, $Ti_3AlC_2$, $Ti_2AlC$, $Al_4C_3$, $Al_4SiC_4$, $Al_4Si_2C_5$, $Al_8SiC_7$, $V_2C$, (Ti,V)C, $VCr_2C_2$, and $V_2Cr_4C_3$.

* * * * *